US007009335B2

(12) United States Patent
Chen et al.

(10) Patent No.: US 7,009,335 B2
(45) Date of Patent: Mar. 7, 2006

(54) FLUORESCENT TUBE STRUCTURE

(75) Inventors: Guo-Ming Chen, Taoyuan (TW); Jong-Woung Kim, P.O. Box No. 6-57, Junghe, Taipei 235 (TW)

(73) Assignees: MathBright Technology Co., Ltd., Taoyuan (TW); Jong-Woung Kim, Osan (KR)

( * ) Notice: Subject to any disclaimer, the term of this patent is extended or adjusted under 35 U.S.C. 154(b) by 0 days.

(21) Appl. No.: 10/861,412

(22) Filed: Jun. 7, 2004

(65) Prior Publication Data

US 2005/0269954 A1 Dec. 8, 2005

(51) Int. Cl.
*H01J 5/10* (2006.01)
*H01J 7/24* (2006.01)
*H01J 7/26* (2006.01)

(52) U.S. Cl. ..... 313/493; 313/24; 313/484; 313/489; 313/25

(58) Field of Classification Search ..... 313/634, 313/635, 489, 493, 36, 44
See application file for complete search history.

(56) References Cited

U.S. PATENT DOCUMENTS

| | | | | |
|---|---|---|---|---|
| 4,323,810 | A * | 4/1982 | Horstmann | 313/24 |
| 4,694,215 | A * | 9/1987 | Hofmann | 313/44 |
| 5,466,990 | A * | 11/1995 | Winsor | 315/56 |
| 5,479,069 | A * | 12/1995 | Winsor | 313/493 |
| 2003/0076021 | A1 * | 4/2003 | Woolford | 313/44 |

FOREIGN PATENT DOCUMENTS

| | | | |
|---|---|---|---|
| JP | 61240554 | A * | 10/1986 |
| JP | 05182635 | A * | 7/1993 |

* cited by examiner

*Primary Examiner*—Mariceli Santiago
(74) *Attorney, Agent, or Firm*—Troxell Law Office PLLC

(57) ABSTRACT

The present invention relates to a fluorescent tube structure, which fluoresces when connecting electric power, including a base plate and an upper cover forming a enclosed discharge chamber, wherein pellicles applied inside to enable an illuminant to project to the curved surface of the upper cover and then be reflected to the base plate, which enhances illumination and also reduces illumination loss to the lateral, thereby improving illuminant efficiency. The present invention can be used as a backlight on illuminating and electronic display devices.

8 Claims, 5 Drawing Sheets

FLUORESCENT TUBE STRUCTURE

BACKGROUND OF THE INVENTION (a) Field of the Invention

The present invention relates to a fluorescent tube structure, which fluoresces when connecting electric power, and more particularly to apply layers of pellicles to an inner surface of the fluorescent tube and a base plate to enhance illuminant efficiency. The present invention can be used as a backlight of illuminating and electronic display devices.

(b) Description of the Prior Art

Referring to FIG. 1. A conventional fluorescent tube 10, short in life and fast in illumination decay, is formed by applying diluted fluorescent material 12 to an inner surface of a glass tube 11 and then assembled after processing. Referring to FIG. 2. Another conventional fluorescent tube 10, usually with a thickness over 10 mm, is formed by infusing into mercury, Ar, Ne, and Kr etc after vacuuming. Due to a thicker thickness, the tube 10 requires a larger room to install, which lowers the efficiency. With the tube 10 usually used as an illuminating device installing on the ceiling and with its thick and long tube, heat generating from illuminating rises the tube temperature, which yellows the tube after long use, causing a downgrade in illuminant efficiency and also a possible fire.

Another type of illuminant is a backlight of an electronic display device, which divided into an edge side illuminant and a rear direct illuminant. The edge side illuminant, low in luminance and high in cost, is to place an illuminant (Light Emitting Diode, LED) on a lateral of a light guide plate to guide light through the light guide plate to a reflective sheet, wherein forming an area illuminant, and further to illuminate a LCD panel. The rear direct illuminant uses a Cold Cathode Fluorescence Lamp (CCFL) as the illuminant placed on the rear of the LCD, wherein an expand sheet formed in front and a reflective sheet behind. Light from the CCFL will be reflected and expanded and finally illuminated the LCD panel. The rear direct illuminant requires a wider fluorescent tubes' spacing and a thicker tube thickness, which may generate shadows and requires a large installation space, respectively.

SUMMARY OF THE INVENTION

The present invention is to provide an illuminant tube with thin tube thickness, less light loss from lateral and with high illuminant efficiency.

The present invention relates to a fluorescent tube structure, which fluoresces when connecting electric power, comprising a base plate and an upper cover forming a enclosed discharge chamber, wherein a protective pellicle, a reflective pellicle, and a fluorescent pellicle applied inside to enable an illuminant to project to the curved surface of the upper cover and then be reflected to the base plate, which enhances illumination and also reduces illumination loss to the lateral, thereby improving illuminant efficiency. The present invention can be used as a backlight of illuminating and electronic display devices.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
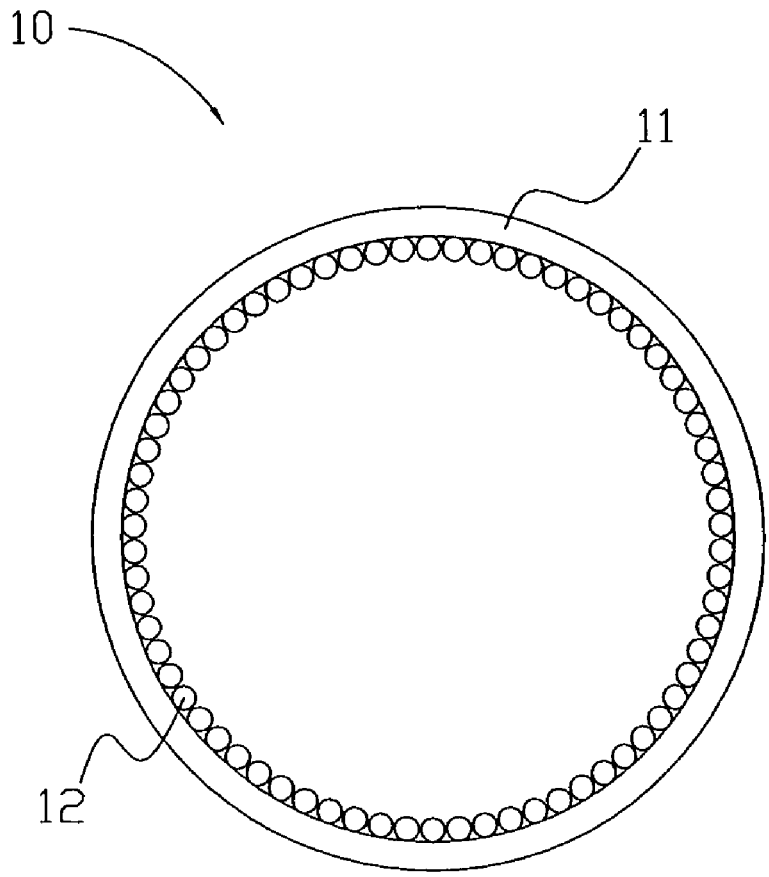
Fig. 1 Prior Art
FIG. 1 shows a perspective view of a conventional fluorescent tube.
Figure 2:
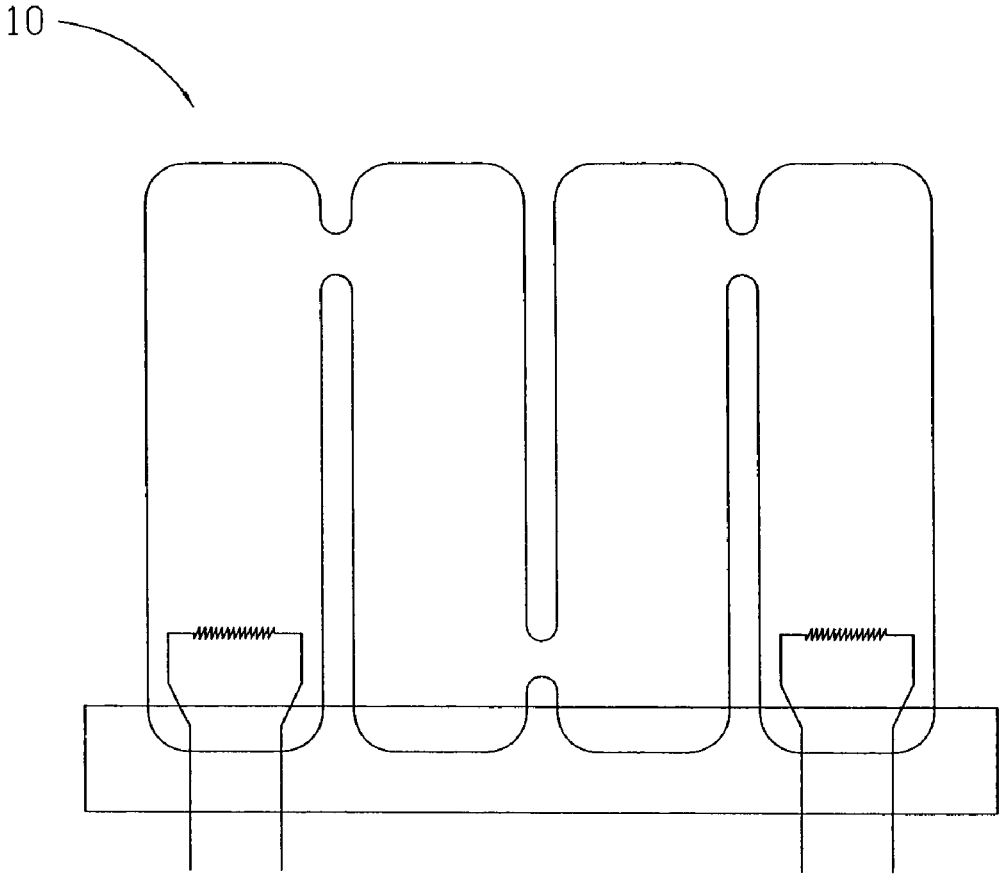
Fig. 2 Prior Art
FIG. 2 shows another perspective view of a conventional fluorescent tube.
Figure 3:
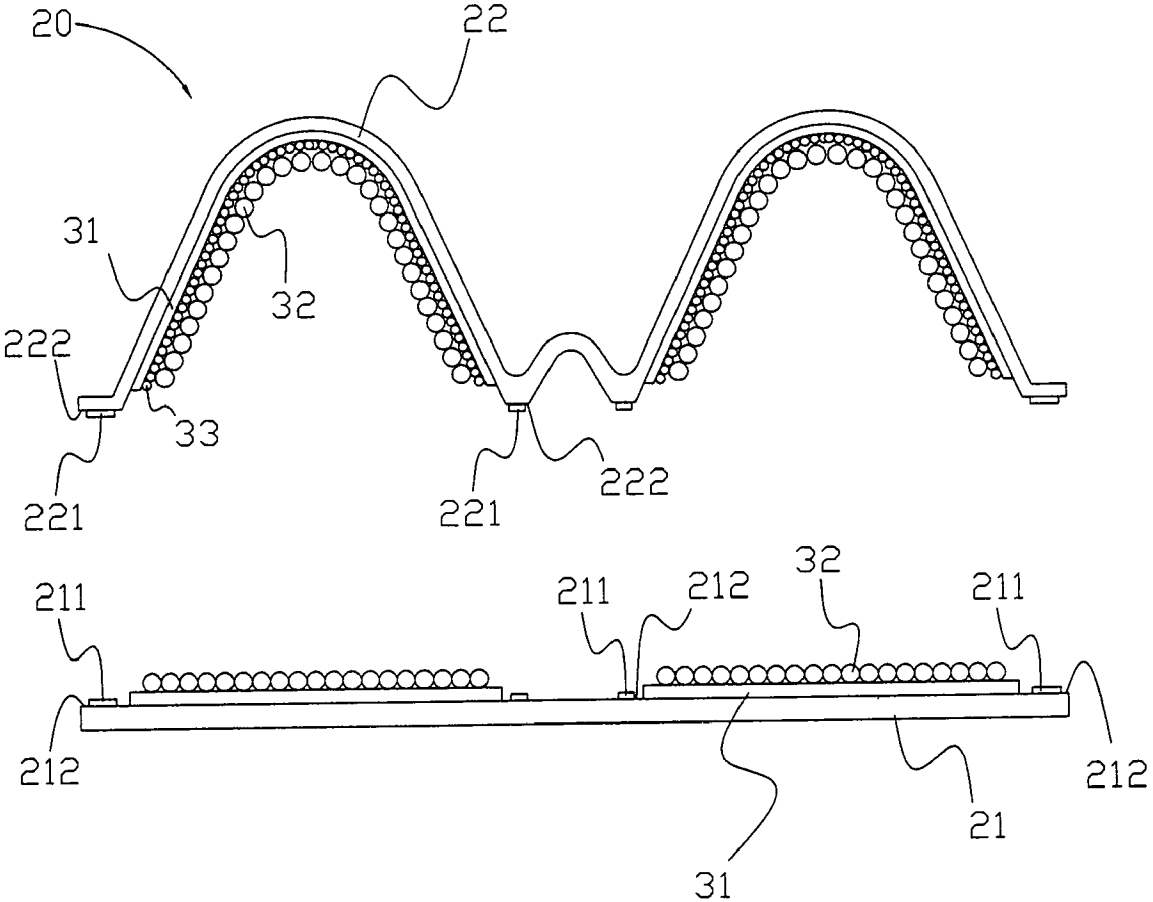
FIG. 3 shows an exploded elevational view of the present invention.

Referring to FIG. 3. The present invention relates to a fluorescent tube 20 comprising a base plate 21 and an upper cover 22, wherein the base plate 21 is of a flat surface and the upper cover 22 is of a heat processed continual wave form. On the base plate 21, a layer of less than 3 $\mu$m protective pellicle 31 and followed by a layer of about 5~20 $\mu$m fluorescent pellicle 32 are applied. On an inner surface of the upper cover 22, a layer of protective pellicle 31, followed by a layer of reflective pellicle 33 and a layer of fluorescent pellicle 32 are applied. The method used for applying pellicle can be coating, steam plating, or printing.

By applying transparent adhesive 221 and 211 on the connection surfaces 222 and 212, respectively, and forcing the upper cover 22 and the base plate 21 to bond together, a discharge chamber 23 thereby formed. To maximize the bonding effect, material for the base plate 21 and the upper cover 22 is preferably with the same or close thermal expansion coefficient.

Figure 4:
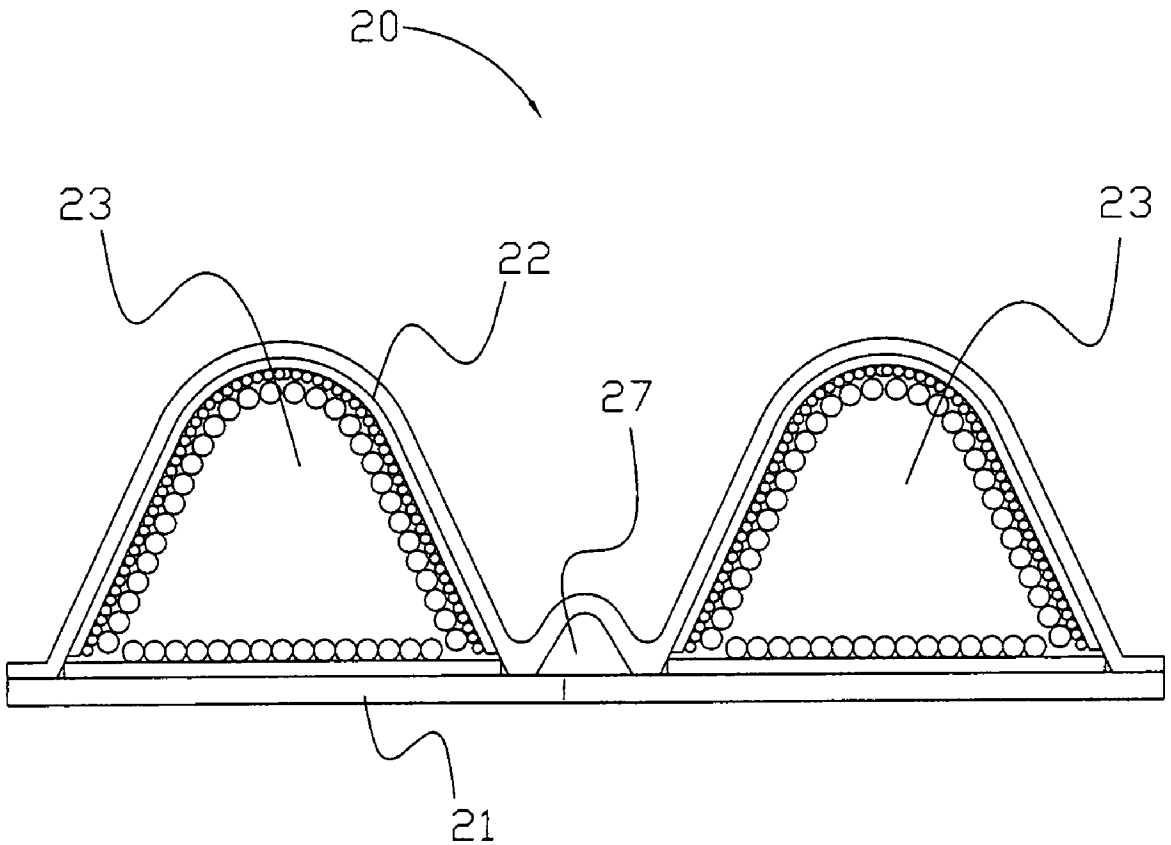
FIG. 4 shows a perspective view of the present invention.
Figure 5:
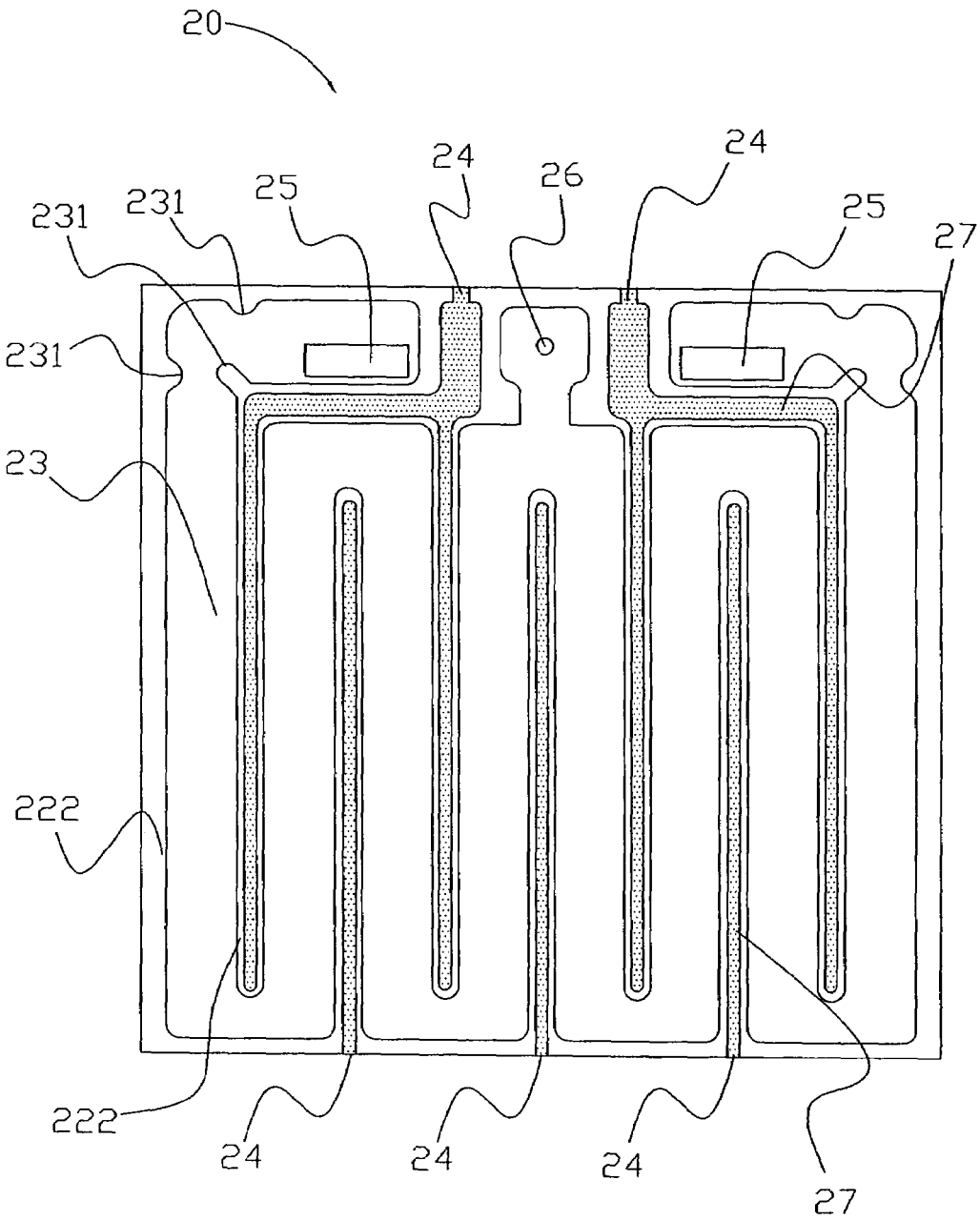
FIG. 5 shows an application of the present invention.

Referring to FIGS. 4 and 5. After formation of the fluorescent tube 20, the discharge chamber 23 is infused with Ar, Ne, and Kr etc, separated or combined, and then with mercury from the exhaust hole 26. The exhaust hole 26 can then be sealed.

Referring to FIG. 5, an application to the present invention. To prevent high temperature, generated due to illuminating, from spreading to a nearby area of the discharge chamber 23, cooling tubes 27 formed, accompanying with cooling holes 24 to exhaust heat energy, thereby keeping the discharge chamber 23 a constant temperature and also an uniform illumination. Electrodes 25 are formed by a Nickel-based fiber, which is advantageous in not only transmitting heat, but also increasing current density and lowering working voltage. To improve blacken on electrodes 25, due to explosive material generated during discharging, suction points 231 closing to electrodes 25 are formed to catch explosive material and also unify the current, thereby creating an uniform illumination, reducing electric charges on the tube and also lowering the electric discharging voltage.

Comparing with the conventional fluorescent tube, the present invention has the following advantages:

1. thin in tube thickness, which reduces the weight;
2. uniform in illumination and light color;
3. lower in production cost;
4. longer in service life.

In summary, the present invention thins the tube, reduces illumination loss to the lateral, and enhances illuminant efficiency.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A fluorescent tube comprising:

a) an upper cover transmitting a light;

b) a base plate directly connected to the upper cover;

c) a discharge chamber formed between the upper cover and the base plate and having two electrodes, an upper cover interior surface, and a base plate interior surface directly connected to the upper cover interior surface;

d) a plurality of cooling tubes formed between the upper cover and the base plate and spaced apart from the discharge chamber;

e) a layer of protective pellicle coating the upper cover interior surface and the base plate interior surface of the discharge chamber;

f) a layer of reflective pellicle coating the layer of protective pellicle located on the upper cover interior surface; and f) a layer of fluorescent pellicle coating the layer of protective pellicle located on the base plate interior surface and the layer of reflective pellicle.

2. The fluorescent tube according to claim 1, wherein the layer of protective pellicle, the layer of reflective pellicle, and the layer of fluorescent pellicle are formed by a process selected from a group consisting of coating, steam plating, and printing.

3. The fluorescent tube according to claim 1, wherein each cooling hole is formed after the base plate is connected to the upper cover.

4. The fluorescent tube according to claim 1, wherein the discharge chamber includes at least one suction point located adjacent to each of the two electrodes.

5. The fluorescent tube according to claim 1, wherein an exhaust hole is formed after the base plate is connected to the upper cover.

6. The fluorescent tube according to claim 1, wherein each of the two electrodes is a nickel based fiber.

7. The fluorescent tube according to claim 1, further comprising an adhesive, the base plate is connected to the upper cover by the adhesive.

8. The fluorescent tube according to claim 1, wherein each of the plurality of cooling tubes having a cooling hole.

* * * * *